United States Patent [19]

Purcell et al.

[11] Patent Number: 5,027,572

[45] Date of Patent: Jul. 2, 1991

[54] MOISTURE AND VAPOR BARRIER IN EXTERIOR INSULATION FINISH SYSTEMS

[75] Inventors: David E. Purcell, Mansfield; Lawrence Shapiro, Randolph, both of Mass.

[73] Assignee: W. R. Grace & Co.-Conn., New York, N.Y.

[21] Appl. No.: 395,238

[22] Filed: Aug. 17, 1989

[51] Int. Cl.[5] ..... E04B 1/70; E04B 2/02

[52] U.S. Cl. ..... 52/309.9; 52/62; 52/363; 52/393; 52/410

[58] Field of Search ..... 52/169.14, 363, 361, 52/362, 351, 352, 354, 517, 516, 309.8, 309.9, 309.11, 309.12, 515, 408, 409, 410, 395, 396, 403, 62, 393

[56] References Cited

U.S. PATENT DOCUMENTS

| | | | |
|---|---|---|---|
| 2,861,525 | 11/1958 | Curtis et al. | 52/515 |
| 3,389,518 | 6/1968 | Horbach | 52/309 |
| 3,411,256 | 11/1968 | Best | 52/408 |
| 4,021,981 | 5/1977 | Van Wagoner | 52/309 |
| 4,374,687 | 2/1983 | Yamamoto | 156/71 |
| 4,464,215 | 8/1984 | Cogliano | 156/71 |
| 4,492,064 | 1/1985 | Bynoe | 52/309 |
| 4,606,168 | 8/1986 | Fuhrer | 52/410 |
| 4,646,498 | 3/1987 | Schneller et al. | 52/309.12 |
| 4,791,768 | 12/1988 | Crean | 52/309.11 |
| 4,875,322 | 10/1989 | Rozzi | 52/309.12 |

FOREIGN PATENT DOCUMENTS

| | | | |
|---|---|---|---|
| 1231167 | 5/1986 | U.S.S.R. | 52/309.9 |

OTHER PUBLICATIONS

Exteriors, "Skyline"; pp. 17–18, Winter 1987.

Pp. 34–38 from *New England Builder*, Jun. 1988 entitled "Troubles with Synthetic Stucco".

Pp. 25–27 of *The Construction Specifier*, Nov., 1988.

*Primary Examiner*—Michael Safavi

*Attorney, Agent, or Firm*—Kevin S. Lemack; William L. Baker

[57] ABSTRACT

A new concept wall system is provided, wherein a moisture and vapor barrier is positioned in an enterior insulation finish system to provide thermal stability regardless of climatic variations. Specifically, a two part membrane of multiple cross-laminated layers of polyethylene film fully bonded to a layer of rubberized asphalt is placed between the substrate and insulation layers of the exterior insulation finish system.

22 Claims, 7 Drawing Sheets

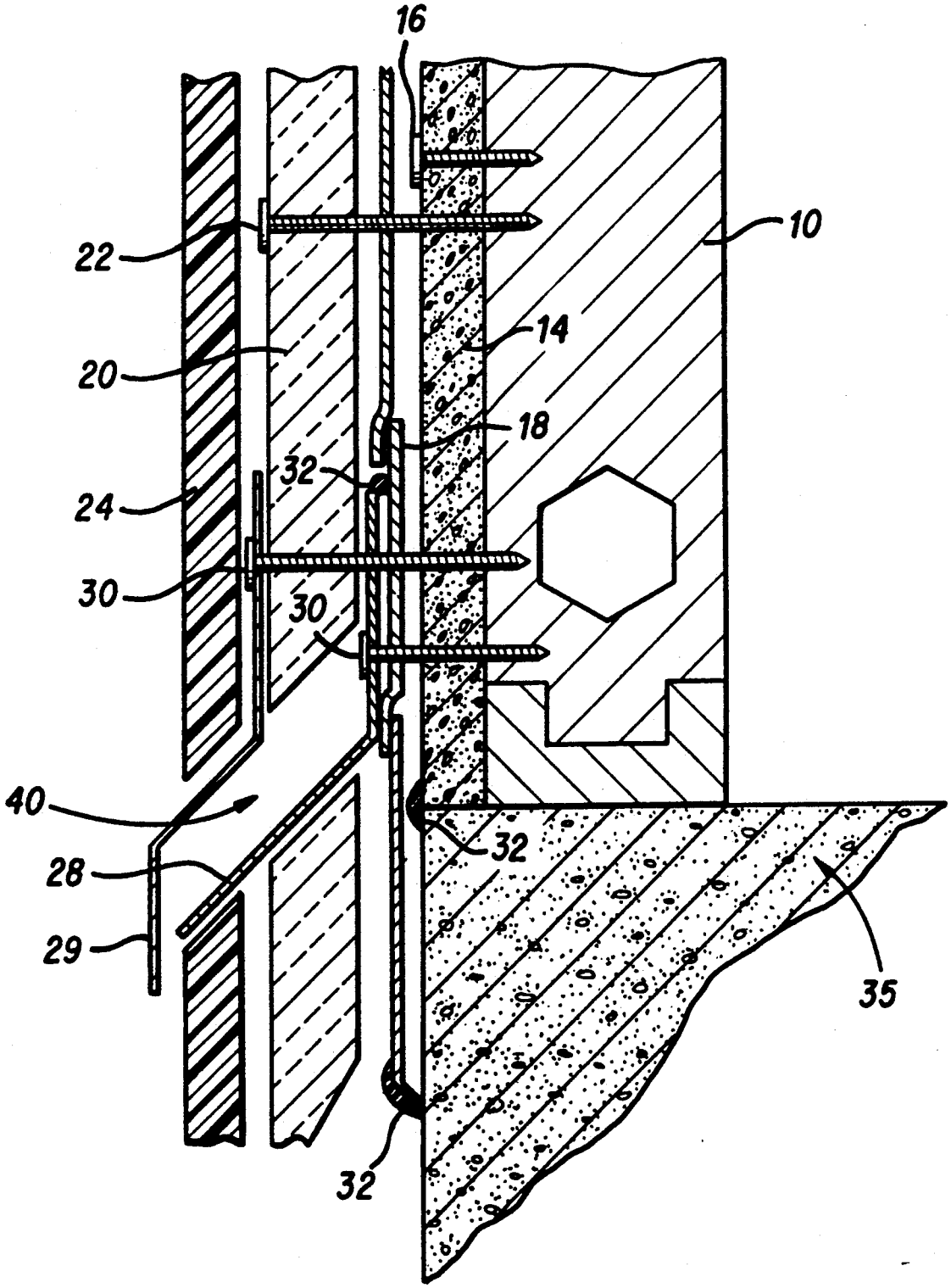
FIG. 2
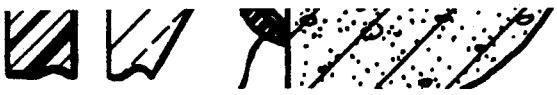

MOISTURE AND VAPOR BARRIER IN EXTERIOR INSULATION FINISH SYSTEMS

FIELD OF THE INVENTION

This invention relates to a water and vapor barrier in an exterior insulation finish system.

BACKGROUND OF THE INVENTION

Exterior insulation finish systems (EIFS) are known in the art. Such systems typically consist of a layer of a substrate such as gypsum, an insulation layer (polystyrene, for example), mesh embedded in a coat of polymer and cement, and a polymeric finish. The polymeric finish can be applied in a variety of textures and colors to satisfy aesthetic requirements. Typical polymeric finishes comprise flexible acrylic latex compositions made by copolymerizing a high Tg monomer such as methylacrylate, ethyl acrylate, methyl methacrylate, etc. with a low Tg monomer such as butyl acrylate, hexyl acrylate, t-butyl acrylate, etc. These compositions are blended with sand to produce the finish. The mesh and polymer-modified cement layers can be applied in multiple layers.

Although such systems are said to be waterproof, problems are caused by water penetration through a variety of avenues such as cracks, joints and sealant failures. Problems include deterioration of the gypsum sheathing facer, loss of attachment of the system, corrosion or rotting of the structural members, spalling and delamination of the coatings and interior building damage. Where deterioration of the gypsum sheathing facer occurs, for example, the result can be the rotting of studs without any conspicuous signs of distress.

Care has been taken in the detailing of termination points such as sills, jambs, heads, parapets, scuffers, corners, and any opening or protrusion in an attempt to make them impervious to moisture. However, such detailing has proven time consuming and ineffective.

The use of waterproofing and vapor barrier membranes in interior insulation systems is known. The placement of the membrane is a function of the climate; the major consideration being that the dew point must occur where the resulting moisture condensation cannot penetrate the insulation. In cold climates, for example, the membrane is placed on the warm side of the insulation (i.e. between the insulation and interior finish) which prevents moisture condensation from penetrating the insulation. However, in regions where variations in climatic temperatures are significant, placement of the membrane to accommodate a colder exterior temperature will be inappropriate when the climate changes to warmer exterior temperatures. That is, in regions with varying climatic temperatures, the location where the dew point occurs and where the resulting moisture condensation forms in the building envelope varies. Heretofore, no suitable solution to the moisture condensation problem has been found.

U.S Pat. No. 3,411,256 discloses what is known in the art as an "upside down" roof. The upside down roof overcame the durability problems of the water impermeable membrane by adhering a layer of thermal insulation on the exterior side of the membrane. A protective layer is then employed to protect the insulating layer from sunlight. The protective layer can be water permeable.

U.S. Pat. No. 4,492,064 teaches a similar roof construction having channels to and in the evaporation of moisture through the insulation panels to the outside atmosphere. Thus disposed over a metal roofing deck is a fire-resistant barrier layer such as gypsum board, a water-permeable layer, a layer of thermal insulation material, and a water-permeable protective layer. The layer of insulation is unsecured to the water-permeable layer to allow for relative movement therebetween.

SUMMARY OF THE INVENTION

The problems of the prior art have been overcome by the instant invention, which provides a moisture and vapor barrier in an exterior insulation system. Specifically, the instant invention combines the EIFS with a two part membrane of multiple cross-laminated layers of polyethylene film, fully bonded to a layer of rubberized asphalt. Such a membrane is sold commercially under the trademark Perm-A-Barrier® by W. R. Grace & Co.-Conn. The membrane is positioned between the substrate and insulation layers of the EIFS. Thus, the exterior insulation system provides relative thermal stability to everything inside it, and allows for freer use of stud-line for plumbing and wiring, while the membrane provides air control through the wall assembly, and provides a water control mechanism for the wall assembly. Accordingly, numerous advantages are realized by the combination encompassed by the instant invention. The water-impermeable membrane acts as a vapor barrier and is strategically located so that the dew point of the air always occurs outside of the building, thereby eliminating moisture condensation problems. The water-impermeable membrane also serves to prevent water penetration into the building that would otherwise occur as a result of cracks, joints and sealant failures in the exterior insulation finish system, notwithstanding its water impermeability. In addition, the thermal insulation layer is mechanically fastened through the water-impermeable membrane to the substrate. The water-impermeable membrane is self-sealing, and therefore forms a seal around the fastening means to prevent water leakage. The use of the water-impermeable membrane between the gypsum board and insulationa eliminates the necessity of using exterior grade gypsum, and adds to the insulation value of the overall system by eliminating air movement in the form of draft.

It is therefore an object of the invention to provide moisture protection and water control in exterior insulation finish systems.

It is a further object of the invention to provide higher overall insulation effectiveness for exterior insulation finish systems.

A still further object of the invention is to provide a waterproofing, air barrier, vapor retarder layer in exterior insulation finish systems.

Another object of the invention is to provide waterproof details through the usage of a membrane system.

Yet another object of the invention is to provide a exterior insulation finish system for a building that insures that the dew point of the air occurs outside the building structure.

BRIEF DESCRIPTION OF THE DRAWING

FIG. 2 an expanded side view of an exterior insulation finish system including a water-permeable membrane as applied to a foundation termination;

DETAILED DESCRIPTION OF THE INVENTION

Figure 1:
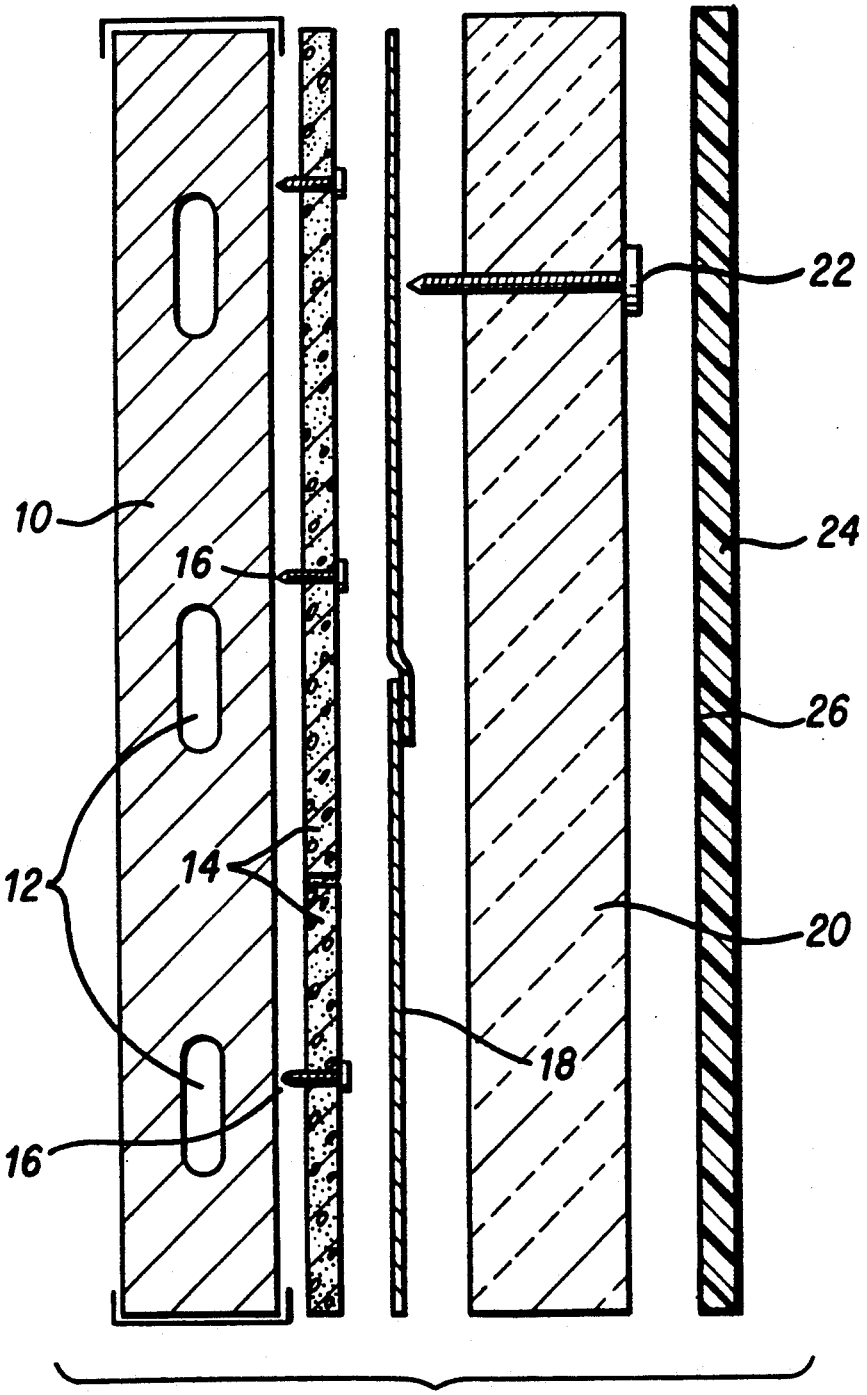
FIG. 1 is an expanded side view of an exterior insulation finish system including a water-permeable membrane in accordance with the present invention.

Referring now to FIG. 1, there is shown an exterior insulation finish system including a water-impermeable membrane in accordance with the instant invention. A structural strength (such as 18 gauge or heavier) light metal framing wall system utilizing a "C" stud 10 with existing cutouts 12 for in-wall plumbing and wiring (gauge and spacing to be determined in accordance with lateral load requirements, A.O.B.E.), to which is attached a ½ "thick gypsum drywall board 14 to the building exterior side of the stud, by means of appropriate size and type mechanical fasteners 16. To the exterior surface of the gypsum drywall board is applied the in-wall air, water, and vapor barrier membrane 18 such that the complete exterior surface of the building (excluding glass surfaces or architectural openings such as door and windows) shall be covered by this membrane, or is connected to a suitable material such that a continuous air, water, and vapor barrier is in place around the entire exterior perimeter of the building, including the roof. To the exterior of the in-wall membrane 18 shall be applied the mechanically attached exterior wall insulation 20 by means of fasteners 22, and the remainder of the finishing system 24, 26, or a modified version, thereof, which will be adapted to reflect the presence of the waterproofing membrane beneath. Suitable exterior wall insulation materials include cellular plastic foams, preferably extruded or expanded polystyrene foam. The remainder of the finishing system includes a water-impermeable polymer-based layer such as an acrylic-based system, preferably comprising blends of sand or quartz with acrylic copolymer latexes.

FIGS. 2–7 illustrate the system of the instant invention as applied to various termination points, etc. Specifically, FIG. 2 shows the system in the context of a foundation termination. In this embodiment, a provision is made for the release of water that might get behind the insulation layer 20 through defects in the exterior finish 24. To this end, flashing material means 28 is attached to the vapor barrier membrane 18 with a suitable sealant 32 and extends through the insulation layer 20 and the exterior finish 24. Exterior grade counterflashing material means 29 is attached t the outer side of the insulation layer 20 by suitable means, such as mechanical fastener 30, and extends through the exterior finish 24 so as to define a weep hole 40 with said flashing 28. The flashing is shaped such that it is unlikely that water would enter the system at a weep hole. Suitable flashing materials include metal, or the membrane itself.

As with the embodiment illustrated in FIG. 1, gypsum board 14 or the like is attached to stud 10 by mechanical fasteners 16. Here, however, both the board 14 and stud 10 sit on the foundation 35. A suitable sealant 32 such as elastomeric sealants, including rubberized asphalt mastic or urethane elastomers, seals any cracks between the board 14 and foundation 35. A water-impermeable membrane 18 is applied to the exterior side of the gypsum board 14 and extend at least partially down the foundation 35. A suitable sealant 32 seals the membrane 18 to the foundation 35 where the membrane 18 terminates. An insulation layer 20 is attached to the exterior side of the membrane 18 by fastening means such as mechanical fasteners 22. The fasteners 22 extend through the membrane 18 which is self-sealing so as to form a water-impermeable seal around the fastening means. The fastening means can extend through the board 14 into stud 10. The exterior finish 24 is applied to the insulation layer in a conventional fashion. The insulation layer 20 and exterior finish 24 are discontinuous to provide for weep hole 40. The weep hole 40 must be located above grade level, and is preferably located just above the foundation termination and at window/door heads.

Figure 3:
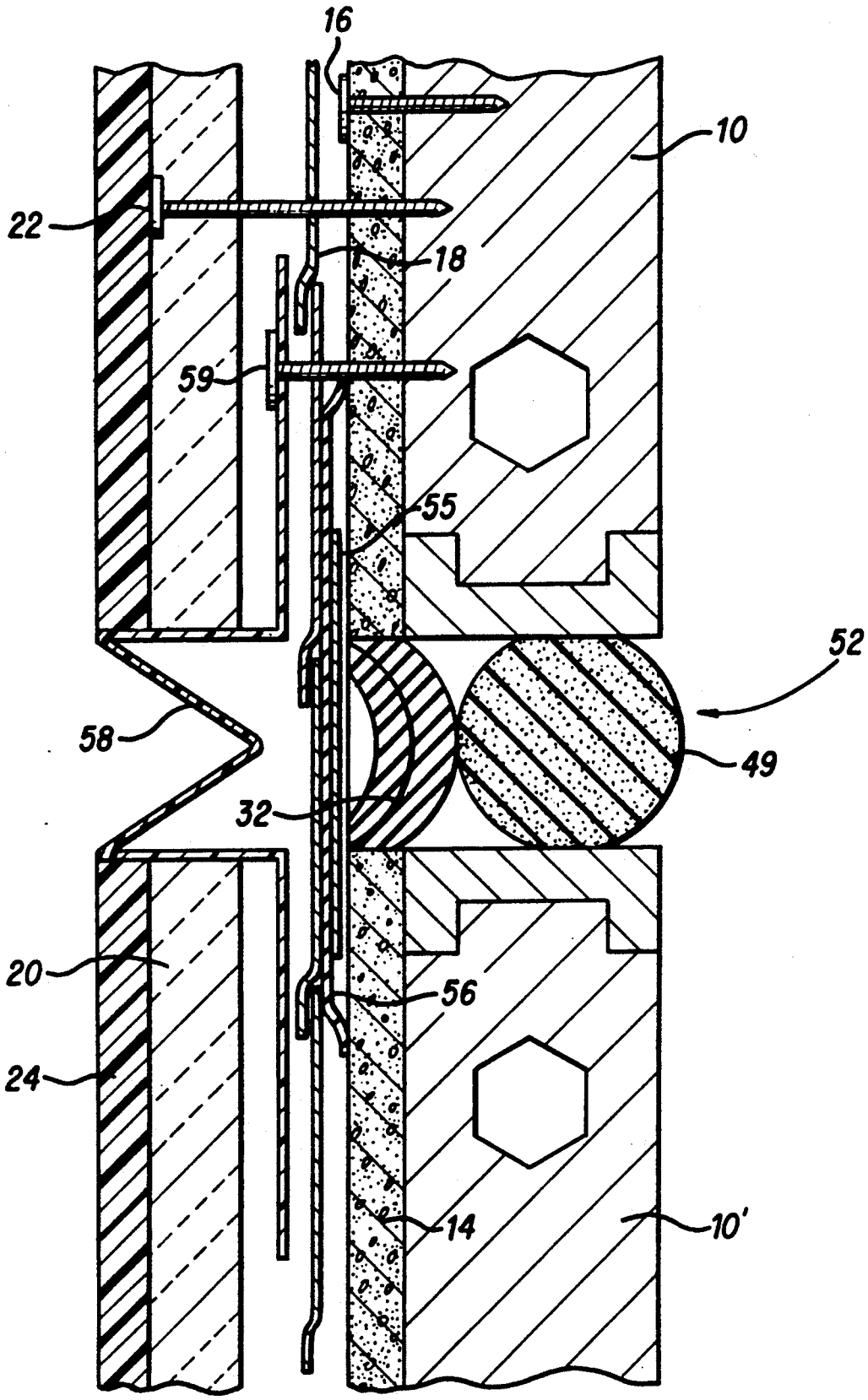
FIG. 3 is an expanded side view of an exterior insulation finish system including a water-permeable membrane as applied to an expansion joint.

FIG. 3 depicts the exterior insulation finish system and membrane of the instant invention as applied to an expansion joint. A backer rod 49 sits in joint 52 between metal studs 10 and 10'. Gypsum board 14 is attached to the stud 10, and a suitable sealant 32 is applied in joint 52 at board 14 and extends to backer rod 49. In this embodiment, a plurality of membrane layers are used to provide moisture impermeability around the joint, while allowing the joint to expand and contract. A first layer 55 is installed over joint 52 as a cover in an inverted manner, i.e., with the rubberized asphalt surface being the exterior side so as to abut the rubberized asphalt surface of a second layer 56 which overlaps the first and the joint 52. The first layer 55 is inverted so that it remains unadhered and can flex as the joint expands and contracts. Similarly, the second layer 56 is not fully adhered. A third layer 18 is applied in accordance with the previous embodiments so as to cover the length of gypsum board 14 and overlap the first and second membrane layers as well. A metal, plastic or sealant expansion joint cover 58 is attached to the system with metal or plastic expansion joint cover fastening means 59, and extends through the insulation layer 20 and exterior finish 24.

Figure 4:
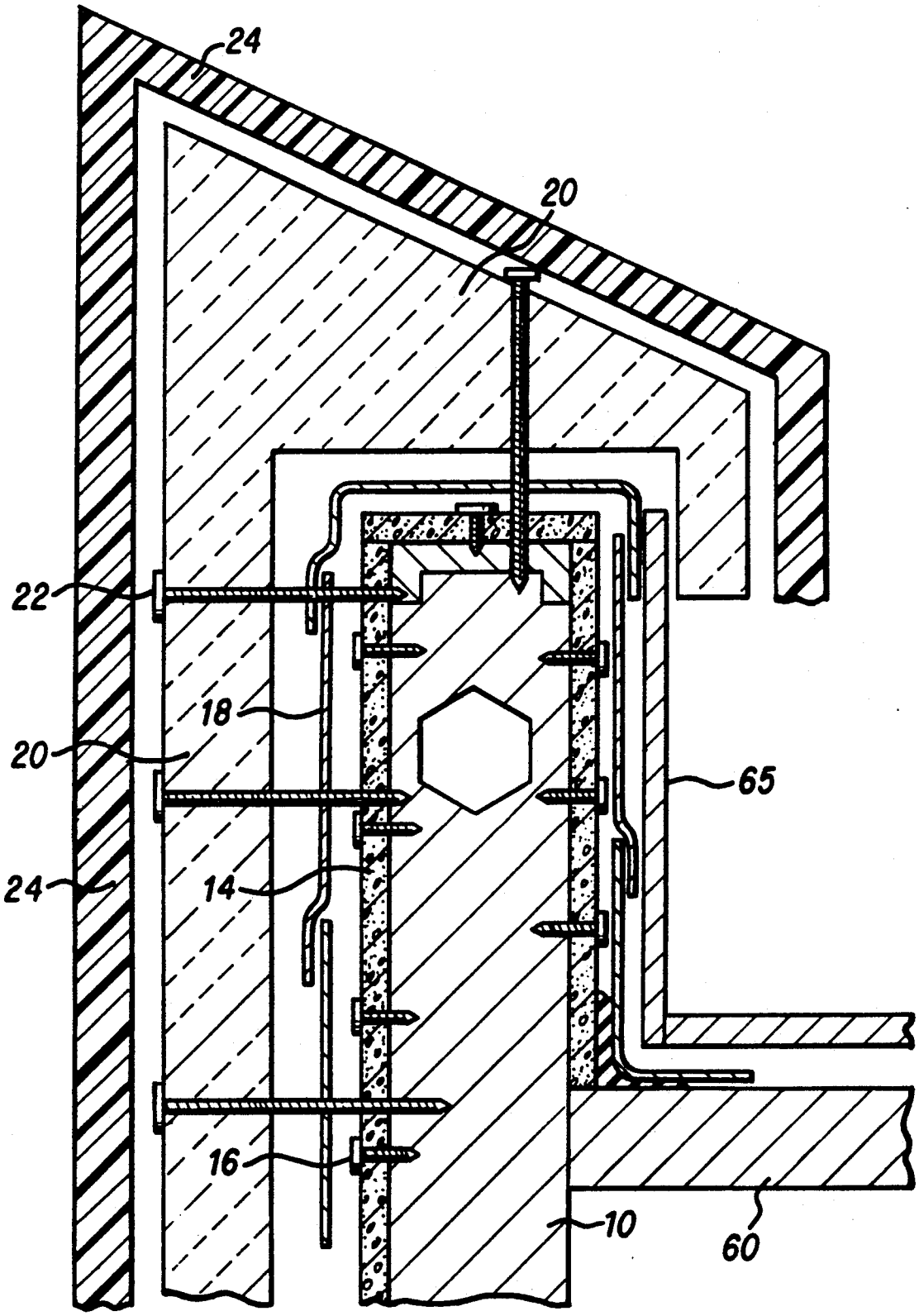
FIG. 4 an expanded side view of an exterior insulation finish system including a water-permeable membrane as applied to a parapet.

FIG. 4 shows the exterior insulation system and membrane of the instant invention forming a parapet cap. Gypsum board 14 is placed around stud 10 and fastened with fastening means 16. Membrane 18 covers the board 14 around stud 10 and under roof system 65 and extends onto roof deck 60. The insulation layer 20 is then attached as shown to extend partially over roof system 65. The exterior finish layer 24 is applied in a conventional manner contiguous to the insulation layer 20

Figure 5:
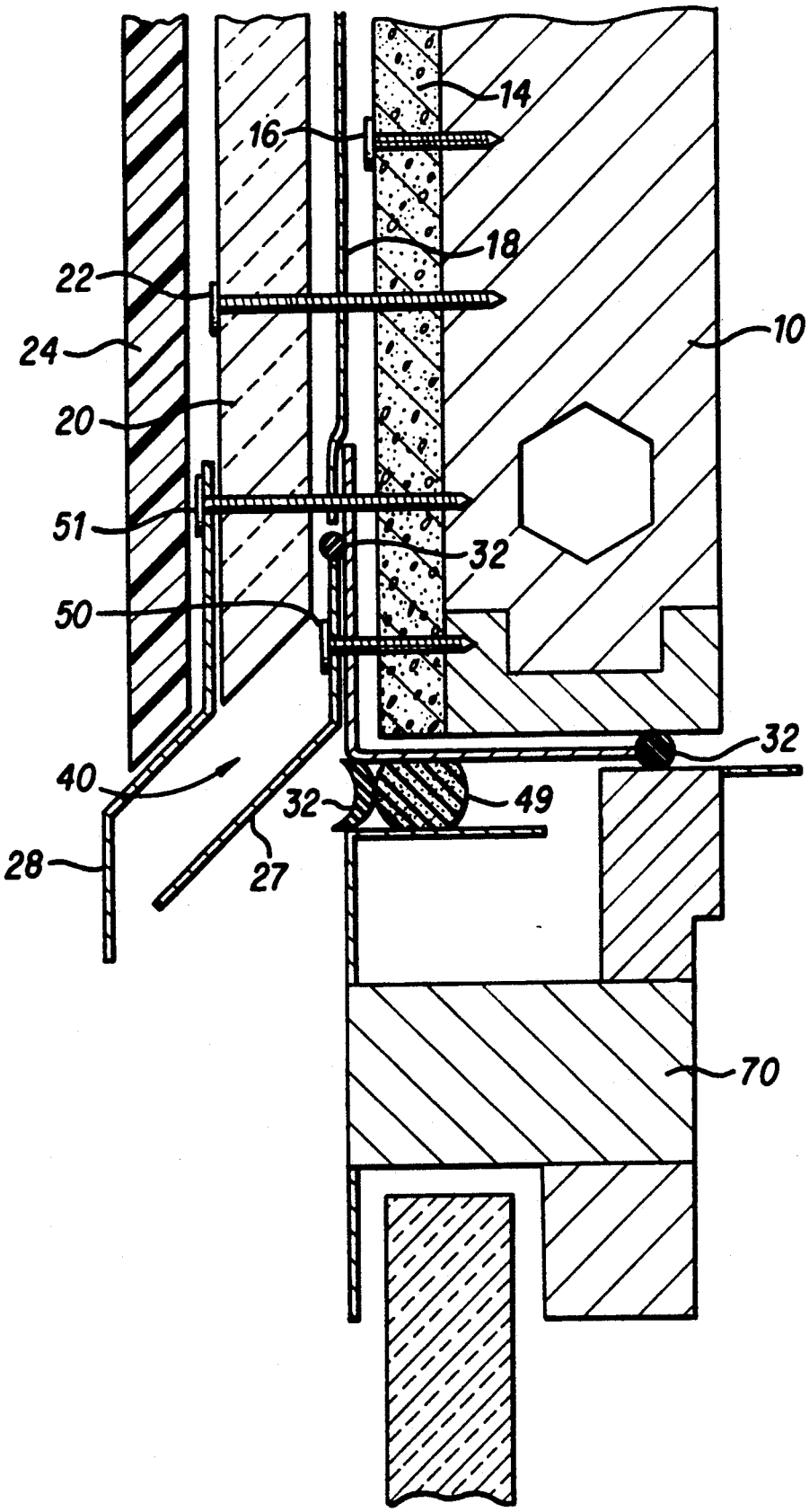
FIG. 5 an expanded side view of an exterior insulation finish system including a water-permeable membrane as applied to a window head.

FIG. 5 shows the exterior insulation finish system and membrane of the instant invention as applied to a window head. As with the foundation termination embodiment, provision is made for the release of moisture from behind the insulation layer. Here the membrane 18 extends under board 14 and stud 10 between the board 14 and stud 10 and the window head 70 Sealant 32 is applied where the membrane 18 terminates at the stud 10, and also between window head 70 and backer rod 49. First flashing means 27 is attached through the membrane 18 by fastening means 50. Second flashing means 28 is attached through the insulation layer 20 by similar means 51 and together with flashing means 28 is suitably shaped to form weep hole 40 to allow moisture that has accumulated behind the insulation above the window head level to be vented from the wall before it reaches the window where the risk of water entry and/or damage is at a maximum. Suitable flashing materials include meral, or the membrane itself.

Figure 6:
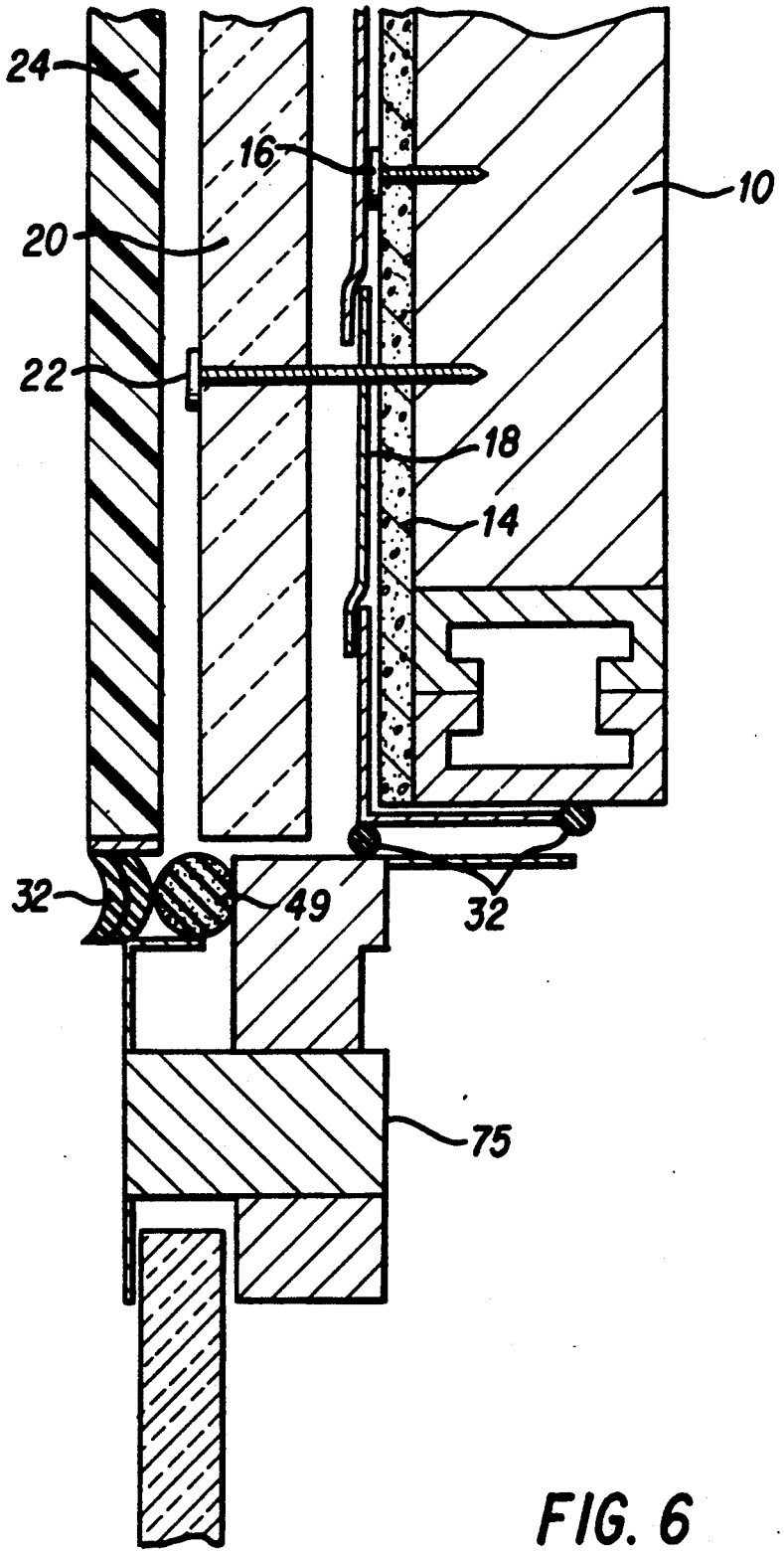
FIG. 6 an expanded side view of an exterior insulation finish including a water-permeable membrane as applied to a window jamb.

FIG. 6 illustrates the exterior insulation finish system and membrane of the instant invention as applied to a window jamb 75. As with the window head embodiment, the membrane 18 extends under the stud 10 and board 14 and is sealed to the stud at its termination point, and to the jamb 75. Insulation layer 20 and exterior finish 24 are attached as previously described.

Figure 7:
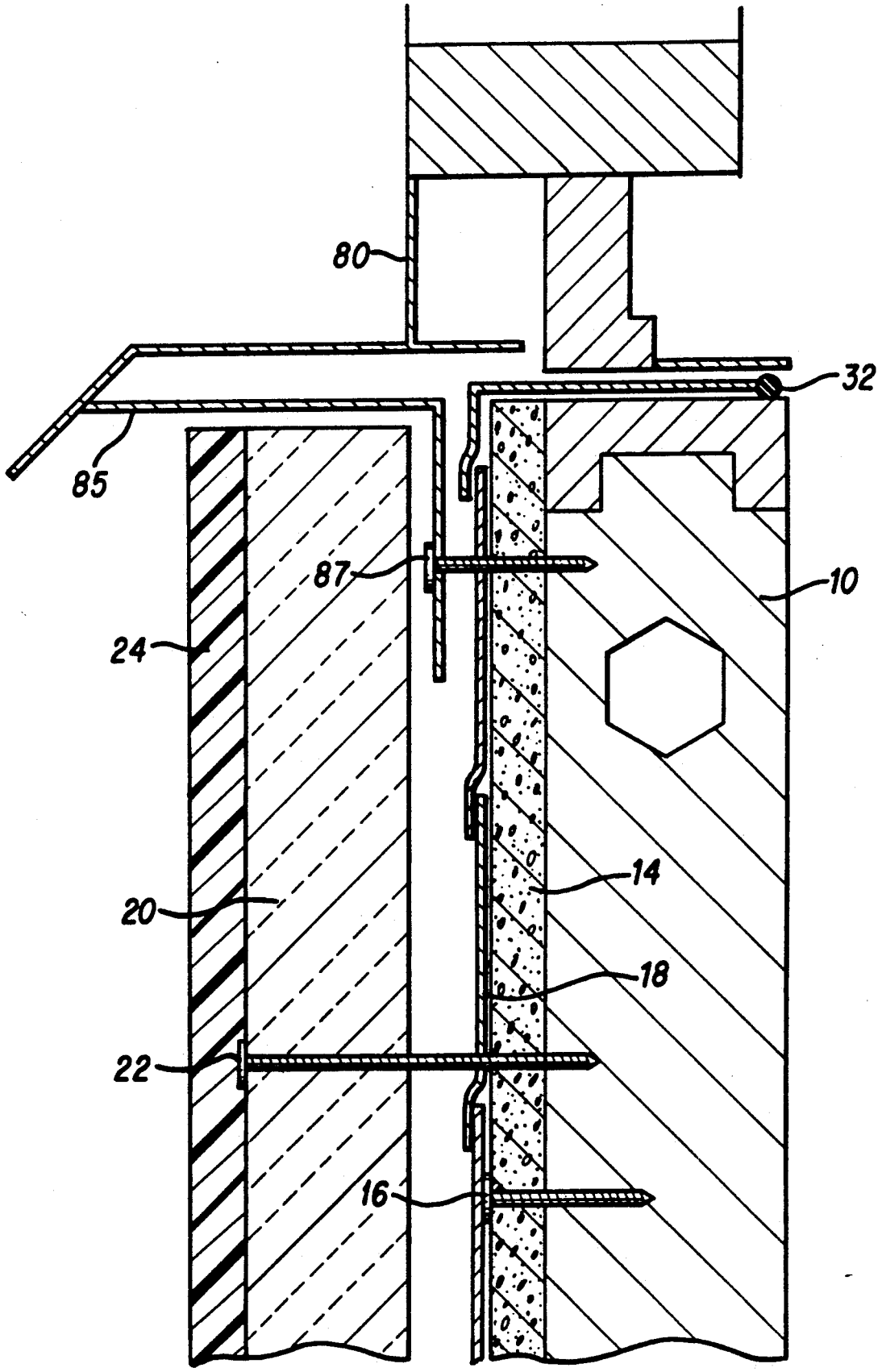
FIG. 7 an expanded side view of an exterior insulation finish system including a water-permeable membrane as applied to a window sill.

FIG. 7 shows the exterior insulation finish system and membrane of the instant invention as applied to a window sill. The membrane 18 is attached to the board 14 and extends over the board 14 and stud 10 under the sill 80. A sealant 32 seals the membrane as its end. An L-shaped window sill flange 85 is mechanically fastened with fastening means 87 to the stud 10. The insulation layer 20 and exterior finish 24 are placed in sequence as before.

What is claimed is:

1. An exterior insulation finish system comprising the following layers in the order provided;

a. a layer of building sheathing;

b. water-impermeable membrane adhered to said sheathing;

c. a layer of thermal insulation fastened through said membrane to said sheathing;

d. a reinforcing layer embedded in a base coat of cement and polymer; and e. an outer water impermeable polymer based layer; said exterior insulation finish system further comprising a passageway extending from said membrane through said outer water-impermeable polymer-based layer to direct moisture out of said system.

2. An exterior insulation finish system according to claim 1, wherein said passageway is defined by a first member having a first portion between said membrane and said insulation and a second portion which extends from said first portion through said insulation and said outer water-impermeable polymer-based layer, and said second member having a first portion between said insulation and said outer water-impermeable polymer-based layer and a second portion which extends from said first portion through said outer water-impermeable polymer-based layer.

3. An exterior insulation finish system according to claim 1 wherein the water-impermeable membrane is self-sealing.

4. An exterior insulation finish system according to claim 1 wherein the water-impermeable membrane comprises a rubberized asphalt adhesive layer.

5. An exterior insulation finish system according to claim 1 wherein the water-impermeable membrane comprises a multiple cross-laminated layer of polyethylene film bonded to a layer of rubberized asphalt.

6. An exterior finish system according to claim 1, wherein the layer of thermal insulation comprises cellular plastic foam.

7. An exterior insulation finish system according to claim 6, wherein the cellular plastic foam comprises extruded polystyrene foam.

8. An exterior insulation finish system according to claim 6, wherein the cellular plastic foam comprises expanded polystyrene foam.

9. An exterior insulation finish system according to claim 1, wherein the water-impermeable polymer-based layer comprises acrylic copolymer latexes.

10. An exterior insulation finish system according to claim 1, wherein the water-impermeable polymer-based layer comprises a blend of sand with acrylic copolymer latex.

11. An exterior insulation finish system according to claim 1, wherein the water-impermeable polymer-based layer comprises a blend of quartz with acrylic copolymer latex.

12. An exterior insulation finish system comprising the following layers in the order provided;

a. a layer of building sheathing;

b. water-impermeable membrane adhered to said sheathing;

c. a layer of thermal insulation fastened through said membrane to said sheathing;

d. a reinforcing layer embedded in a base coat of cement and polymer; and e. an outer water-impermeable polymer-based layer; said exterior insulation finish system further comprising a first layer of water-impermeable membrane covering an expansion joint in said sheathing, a second layer of a water-impermeable membrane covering said first layer; said first and second layers being covered by said water-impermeable membrane adhered to said sheathing.

13. An exterior insulation system according to claim 12, wherein said first and second layers each comprise a multiple cross-laminated layer of polyethylene film bonded to a layer of rubberized asphalt, and wherein said rubberized asphalt layer of said first layer faces said rubberized asphalt layer of said second layer.

14. An exterior insulation finish system according to claim 12, wherein the water-impermeable membrane is self-sealing.

15. An exterior insulation finish system according to claim 12, wherein the water-impermeable membrane comprises are rubberized asphalt adhesive layer.

16. An exterior insulation finish system according to claim 12, wherein the water-impermeable membrane comprises a multiple cross-laminated layer of polyethylene film bonded to a layer of rubberized asphalt.

17. An exterior insulation finish system according to claim 12, wherein the layer of thermal insulation comprises cellular plastic foam.

18. An exterior insulation finish system according to claim 17, wherein the cellular plastic foam comprises extruded polystyrene foam.

19. An exterior insulation finish system according to claim 17, wherein the cellular plastic foam comprises expanded polystyrene foam.

20. An exterior insulation finish system according to claim 12, wherein the water-impermeable polymer-based layer comprises acrylic copolymer latexes.

21. An exterior insulation finish system according to claim 12, wherein the water-impermeable polymer-based layer comprises a blend of sand with acrylic copolymer latex.

22. An exterior insulation finish system according to claim 12, wherein the water-impermeable polymer-based layer comprises blend of quartz with acrylic copolymer latex.

* * * * *